US010302087B2

(12) United States Patent
Yang et al.

(10) Patent No.: US 10,302,087 B2
(45) Date of Patent: May 28, 2019

(54) COMPRESSOR EXHAUST STRUCTURE, SCREW COMPRESSOR AND AIR-CONDITIONING UNIT HAVING SAME

(71) Applicant: GREE ELECTRIC APPLIANCES, INC. OF ZHUHAI, Zhuhai, Guangdong (CN)

(72) Inventors: Qiaoming Yang, Zhuhai (CN); Rihua Li, Zhuhai (CN); Tianyi Zhang, Zhuhai (CN); Guanghui Xia, Zhuhai (CN); Gongsheng Tan, Zhuhai (CN); Weijun Lin, Zhuhai (CN); Hao Long, Zhuhai (CN); Yushi Bi, Zhuhai (CN); Yanhai Peng, Zhuhai (CN); Kang Xu, Zhuhai (CN)

(73) Assignee: Gree Electric Appliances, Inc. of Zhuhai, Zhuhai, Guangdong (CN)

( * ) Notice: Subject to any disclaimer, the term of this patent is extended or adjusted under 35 U.S.C. 154(b) by 152 days.

(21) Appl. No.: 15/508,936

(22) PCT Filed: Dec. 26, 2014

(86) PCT No.: PCT/CN2014/095094
§ 371 (c)(1),
(2) Date: Mar. 6, 2017

(87) PCT Pub. No.: WO2016/041288
PCT Pub. Date: Mar. 24, 2016

(65) Prior Publication Data

US 2017/0284399 A1 Oct. 5, 2017

(30) Foreign Application Priority Data

Sep. 19, 2014 (CN) ..... 2014 1 0484160

(51) Int. Cl.
*F01C 1/24* (2006.01)
*F03C 2/00* (2006.01)
(Continued)

(52) U.S. Cl.
CPC ..... *F04C 29/12* (2013.01); *F04C 18/16* (2013.01); *F04C 29/026* (2013.01);
(Continued)

(58) Field of Classification Search
CPC ..... F04C 18/16; F04C 29/12; F04C 29/026; F04C 2240/56; F04C 2240/20; F04C 2240/50
(Continued)

(56) References Cited

U.S. PATENT DOCUMENTS 6,045,344 A 4/2000 Tsuboi et al.
6,364,645 B1 4/2002 Dieterich
(Continued)

FOREIGN PATENT DOCUMENTS

CN 201513352 U 6/2010
CN 202100461 U 1/2012
(Continued)

OTHER PUBLICATIONS

Written Opinion of the International Searching Authority, PCT/CN2014/095094, dated Jun. 29, 2015, Chinese language, 4 pages.
(Continued)

*Primary Examiner* — Theresa Trieu
(74) *Attorney, Agent, or Firm* — Faegre Baker Daniels LLP

(57) ABSTRACT

A compressor exhaust structure includes a machine body, an exhaust bearing seat provided at an exhaust end of the machine body and an oil separating barrel covering the exhaust bearing seat, the exhaust bearing seat is provided with a first exhaust chamber, the machine body is provided
(Continued)

with a second exhaust chamber, a third exhaust chamber is formed between the exhaust bearing seat and an inner wall of the oil separating barrel, the first exhaust chamber is in fluid communication with the second exhaust chamber, the second exhaust chamber is in fluid communication with the third exhaust chamber, and the third exhaust chamber is in fluid communication with a discharge port of the oil separating barrel. The compressor exhaust structure increases the flow path of the gas flow, facilitates the insulation of gas flow noise and reduces gas flow pulsation.

11 Claims, 3 Drawing Sheets

(51) Int. Cl.

| | |
|---|---|
| ***F03C 4/00*** | (2006.01) |
| ***F04C 29/12*** | (2006.01) |
| ***F04C 18/16*** | (2006.01) |
| ***F04C 29/02*** | (2006.01) |

(52) U.S. Cl.
CPC ..... *F04C 2240/20* (2013.01); *F04C 2240/50* (2013.01); *F04C 2240/56* (2013.01)

(58) Field of Classification Search
USPC ..... 418/83, 201.1–201.3
See application file for complete search history.

(56) References Cited

U.S. PATENT DOCUMENTS 6,976,833 B2 * 12/2005 Daniels ..... F04C 18/16 418/201.1
2001/0036417 A1 * 11/2001 Hioki ..... F04C 18/16 418/201.1
2007/0092393 A1 4/2007 Egan
2010/0135839 A1 * 6/2010 Fraser ..... F04C 18/086 418/197
2015/0078928 A1 3/2015 Wei et al.

FOREIGN PATENT DOCUMENTS

| | | | |
|---|---|---|---|
| CN | 103362807 | A | 10/2013 |
| CN | 204113661 | U | 1/2015 |
| DE | 19845993 | A1 | 4/2000 |
| EP | 1609994 | A3 | 5/2008 |
| EP | 2336567 | A2 | 6/2011 |
| JP | H0326879 | A | 2/1991 |
| JP | H10159763 | A | 6/1998 |
| JP | 2000009074 | A | 1/2000 |
| KR | 20130102357 | A | 9/2013 |

OTHER PUBLICATIONS

Written Opinion of the International Searching Authority, PCT/CN2014/095094, dated Jun. 29, 2015, English translation, 6 pages.
European Patent Office, Communication and Supplementary European Search Report and Annex thereto, European Patent Application No. 14902064.6 to Gree Electric Appliances, Inc. of Zhuhai, dated Apr. 9, 2018, 7 pages.
International Search Report and Written Opinion (in Chinese language), issued by the State Intellectual Property Office of the People's Republic of China, dated Jun. 29, 2015, for International Application No. PCT/CN2014/095094 (includes English translation of the International Search Report), 15 pages.

* cited by examiner

COMPRESSOR EXHAUST STRUCTURE, SCREW COMPRESSOR AND AIR-CONDITIONING UNIT HAVING SAME

This application is the national phase of International Application No. PCT/CN2014/095094, titled "COMPRESSOR EXHAUST STRUCTURE, SCREW COMPRESSOR AND AIR-CONDITIONING UNIT HAVING SAME", filed on Dec. 26, 2014 which claims the benefit of priority to Chinese Patent Application No. 201410484160.8 titled "COMPRESSOR EXHAUST STRUCTURE, SCREW COMPRESSOR AND AIR-CONDITIONING UNIT HAVING SAME", filed with the Chinese State Intellectual Property Office on Sep. 19, 2014, the entire disclosures of which applications are incorporated herein by reference.

FIELD

The present application relates to the field of compressors, and particularly to a compressor exhaust structure, a screw compressor having the compressor exhaust structure and an air-conditioning unit having the screw compressor.

BACKGROUND

In a semi-closed screw compressor, when the compressor is not provided with a built-in oil separating core, an exhaust bearing seat is surrounded by an oil separating barrel so as to reduce noise. In this case, gas discharged from the compressor flows into the oil separating barrel through the exhaust bearing seat, and then is discharged from the compressor via a discharge port of the oil separating barrel. Since the compressor is not provided with the built-in oil separating core, the discharge port of the oil separating barrel must be located at a lower part of the oil separating barrel, such that refrigerant oil carried in the exhaust gas can be smoothly discharged out of the compressor. For a screw compressor with a slide valve structure arranged at a lower part, generally, an exhaust port of the exhaust bearing seat is positioned in a lower part of the exhaust bearing seat. In this case, the discharge port of the exhaust bearing seat is too close to the discharge port of the oil separating barrel, therefore the function of insulating the noise of the oil separating barrel cannot be sufficiently exerted.

SUMMARY

An object of the present application is to provide a compressor exhaust structure, a screw compressor and an air-conditioning unit, which can effectively reduce the noise from gas flow pulsation.

In order to achieve the above object, a compressor exhaust structure according to the present application is provided, which includes a machine body, an exhaust bearing seat provided at an exhaust end of the machine body and an oil separating barrel covering the exhaust bearing seat, the exhaust bearing seat is provided with a first exhaust chamber, the machine body is provided with a second exhaust chamber, a third exhaust chamber is formed between the exhaust bearing seat and an inner wall of the oil separating barrel, the first exhaust chamber is in fluid communication with the second exhaust chamber, the second exhaust chamber is in fluid communication with the third exhaust chamber, and the third exhaust chamber is in fluid communication with a discharge port of the oil separating barrel.

In a preferred or alternative embodiment, the interior of the first exhaust chamber is located opposite to the interior of the second exhaust chamber, and the first exhaust chamber is overlapped with a portion of the second exhaust chamber, and the portion, which is not overlapped with the first exhaust chamber, of the second exhaust chamber forms a gas flow passage communicating with the third exhaust chamber In a preferred or optional embodiment, the first exhaust chamber includes a bearing exhaust port and a bearing discharge chamber, the bearing exhaust port is arranged in an axial direction of the exhaust bearing seat, the bearing discharge chamber is arranged in an intake-side end surface of the exhaust bearing seat, and the bearing exhaust port is in communication with the bearing discharge chamber.

In a preferred or optional embodiment, the bearing exhaust port is arranged below a male rotor bearing chamber and a female rotor bearing chamber in the exhaust bearing seat and is located at an exhaust end of a slide valve chamber in the exhaust bearing seat.

In a preferred or optional embodiment, the bearing discharge chamber is located below the male rotor bearing chamber in the exhaust bearing seat, and the second exhaust chamber is located below the male rotor chamber in the machine body.

In a preferred or optional embodiment, a baffle is provided on the exhaust bearing seat at a position where the bearing discharge chamber is arrange, the gas flow from the bearing discharge chamber is entered into the second exhaust chamber by the baffle.

In order to achieve the above object, a screw compressor is also provided according to the present application, which includes the compressor exhaust structure according to any one of the above embodiments.

In order to achieve the above object, an air-conditioning unit is also provided according to the present application, which includes the screw compressor according to any one of the above embodiments.

Based on the above technical solutions, the present applicant at least has the following beneficial effects.

In the present application, the exhaust bearing seat is provided with a first exhaust chamber, the machine body is provided with a second exhaust chamber, a third exhaust chamber is formed between the exhaust bearing seat and an inner wall of the oil separating barrel, the exhaust bearing seat and the machine body are arranged to cooperate with each other, so that the exhaust gas flows into the second exhaust chamber of the machine body through the first exhaust chamber of the exhaust bearing seat, and then enters the third exhaust chamber from the second exhaust chamber, and finally enters the discharge port of the oil separating barrel through the third exhaust chamber to be discharged, which increases the flow path of the gas flow, facilitates the insulation of gas flow noise and reduces gas flow pulsation.

BRIEF DESCRIPTION OF THE DRAWING

The drawings described here are intended to facilitate a further understanding to the present application, and constitute a part of the present application. The exemplary embodiments of the present application and the description thereof are provided for the purpose of explaining the present application, and are not intended to unduly limit the present application. In the drawings.

DETAILED DESCRIPTION

Figure 1:
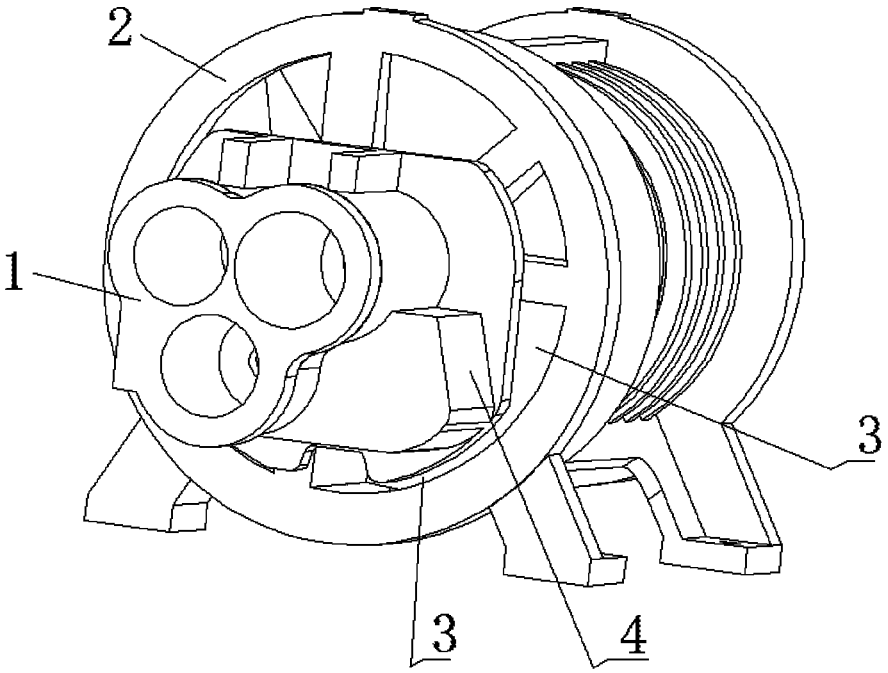
FIG. 1 is an isometric view showing an exhaust bearing seat and a machine body of a compressor exhaust structure according to the present application in an assembled state.

Technical solutions of embodiments of the present application will be clearly and completely described hereinafter in conjunction with the drawings of the embodiments of the present application. Apparently, the embodiments described below are only some examples of the present application, rather than all embodiments. Other embodiments obtained by those skilled in the art based on the embodiments of the present application without any creative efforts all fall into the scope of the present application.

In the description of the present application, it is to be understood that the orientation or positional relationships indicated by terms "center", "longitudinal", "transverse", "front", "rear", "left", "right", "vertical", "horizontal", "top", "bottom", "inner", "outer" and the like are based on the orientation or positional relationships shown in the drawings, and are merely for the convenience of describing the present application and the simplification of the description, and do not indicate or imply that the device or element referred to must be in a particular orientation, or be constructed and operated in a particular orientation, and therefore should not be construed as a limit to the scope of the present application.

Figure 2:
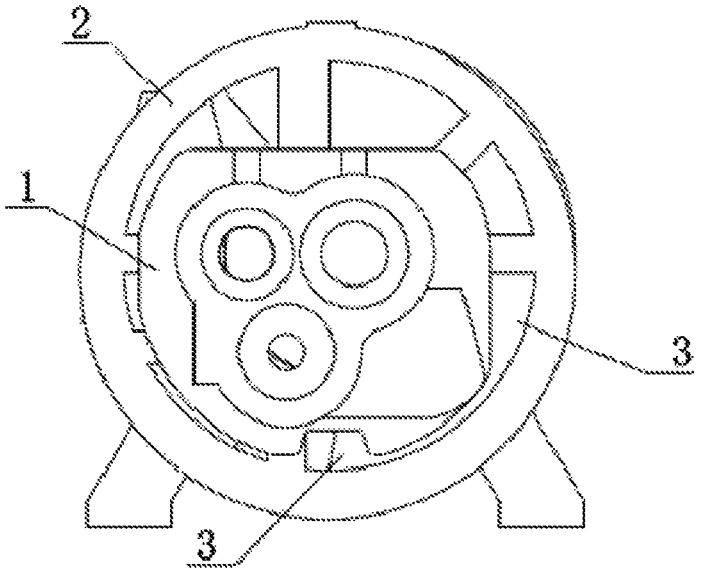
FIG. 2 is a schematic view showing the structure of an exhaust end in a state that the exhaust bearing seat and the machine body of the compressor exhaust structure according to the present application are assembled.
Figure 3:
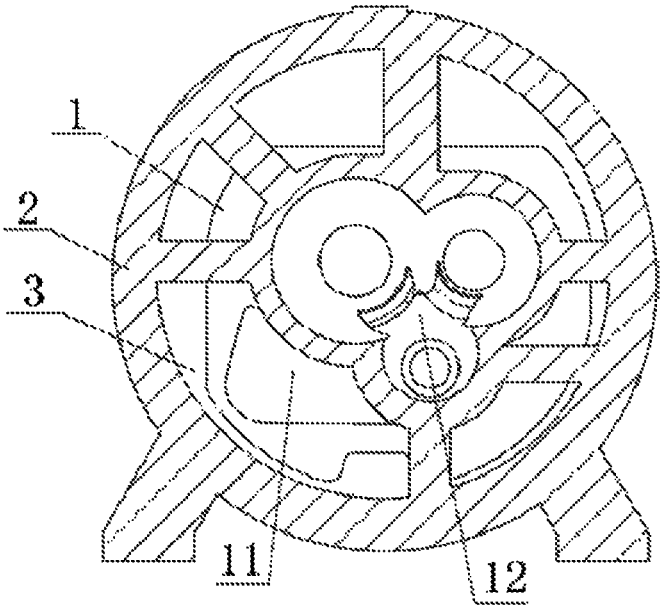
FIG. 3 is a schematic sectional view of an intake end in the state that the exhaust bearing seat and the machine body of the compressor exhaust structure according to the present application are assembled.
Figure 6:
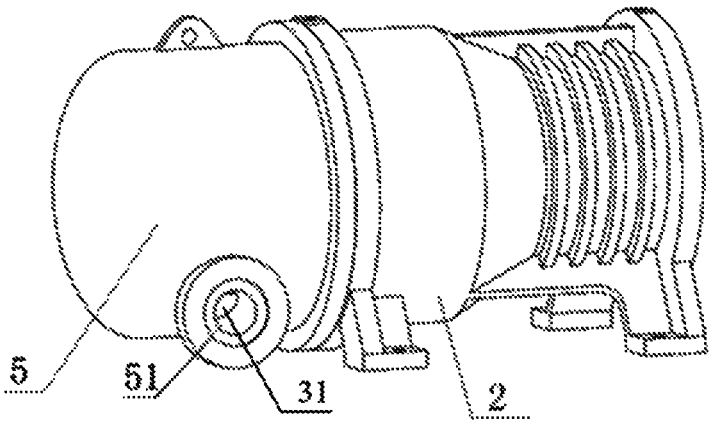
FIG. 6 is a schematic view showing an external structure of a screw compressor according to the present application.

As shown in FIGS. 1, 2 and 3, an exemplary embodiment of a compressor exhaust structure according to the present application is illustrated. In the exemplary embodiment, the compressor exhaust structure includes an exhaust bearing seat 1, a machine body 2 and an oil separating barrel 5 (as shown in FIG. 6). The exhaust bearing seat 1 is provided at an exhaust end of the machine body 2. The exhaust bearing seat 1 is covered by the oil separating barrel 5, and the oil separating barrel 5 is connected to the machine body 2. The exhaust bearing seat 1 is provided with a first exhaust chamber, the machine body 2 is provided with a second exhaust chamber 21, and a third exhaust chamber 31 is formed between the exhaust bearing seat 1 and an inner wall of the oil separating barrel 5. The first exhaust chamber is in fluid communication with the second exhaust chamber 21, the second exhaust chamber 21 is in fluid communication with the third exhaust chamber 31, and the third exhaust chamber 31 is in fluid communication with a discharge port 51 of the oil separating barrel 5. The gas flow enters the second exhaust chamber 21 via the first exhaust chamber, and then enters the third exhaust chamber 31 from the second exhaust chamber 21, and finally is discharged via the discharge port 51 of the oil separating barrel 5, which increases a flow path of the gas flow, facilitates the insulation of gas flow noise, and reduces gas flow pulsation.

In an exemplary embodiment of the compressor exhaust structure according to the present application, the interior of the first exhaust chamber faces towards the interior of the second exhaust chamber 21, and the first exhaust chamber is overlapped with a part of the second exhaust chamber 21, and a portion, which is not overlapped with the first exhaust chamber, of the second exhaust chamber 21 forms a gas flow passage 3 in communication with the third exhaust chamber 31. The gas flow enters the second exhaust chamber 21 via the first exhaust chamber, and then flows into the third exhaust chamber 31 from the second exhaust chamber 21 through the gas flow passage 3.

In the compressor exhaust structure according to the present application, the gas flow exhausted from the exhaust bearing seat 1 enters the machine body 2 firstly, and then enters the oil separating barrel 5 from the machine body 2, and finally flows out, which extends the flow path of the gas flow, facilitates the insulation of gas flow noise, and reduces gas flow pulsation.

Hereinafter, the structures of the exhaust bearing seat 1 and the machine body 2 according to the exemplary embodiment of the present application will be described in detail.

Figure 4:
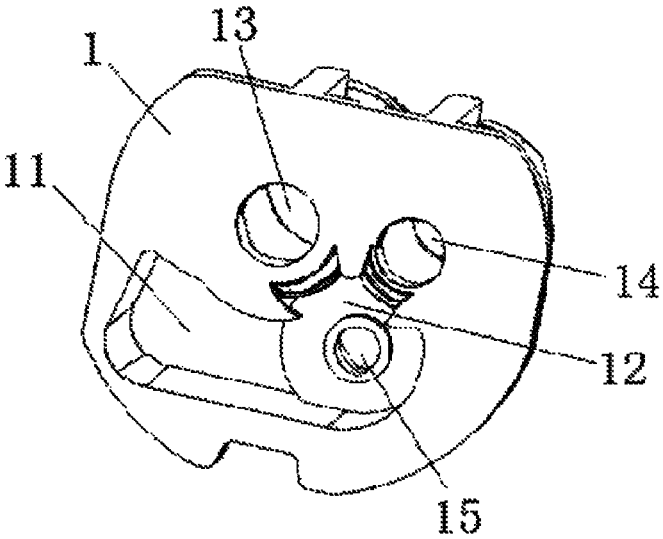
FIG. 4 is a schematic view showing the structure of an end surface of the exhaust bearing seat of the compressor exhaust structure according to the present application.

As shown in FIG. 4, the exhaust bearing seat 1 is provided with the first exhaust chamber, a male rotor bearing chamber 13, a female rotor bearing chamber 14, and a slide valve chamber 15. The first exhaust chamber includes a bearing discharge chamber 11 and a bearing exhaust port 12. The bearing exhaust port 12 is arranged in an axial direction of the exhaust bearing seat 1, and the bearing exhaust port 12 is located below the male rotor bearing chamber 13 and the female rotor bearing chamber 14 and located at an exhaust end of the slide valve chamber 15. The bearing discharge chamber 11 is arranged on an intake-side end surface of the exhaust bearing seat 1 and is in communication with the bearing exhaust port 12. The high-pressure gas in the rotor chamber enters the exhaust bearing seat 1 via the bearing exhaust port 12, and then is discharged out of the exhaust bearing seat 1 through the bearing discharge chamber 11 in the exhaust bearing seat 1.

In the above-described exemplary embodiment, the bearing discharge chamber 11 of the exhaust bearing seat 1 is arranged in the intake-side end surface of the exhaust bearing seat 1, and the exhaust bearing seat 1 is provided with a baffle 4 (as shown in FIG. 1) at a position where the bearing discharge chamber 11 is located, and by the baffle 4, the gas flow from the bearing discharge chamber 11 may be allowed to enter the second exhaust chamber 21.

Figure 5:
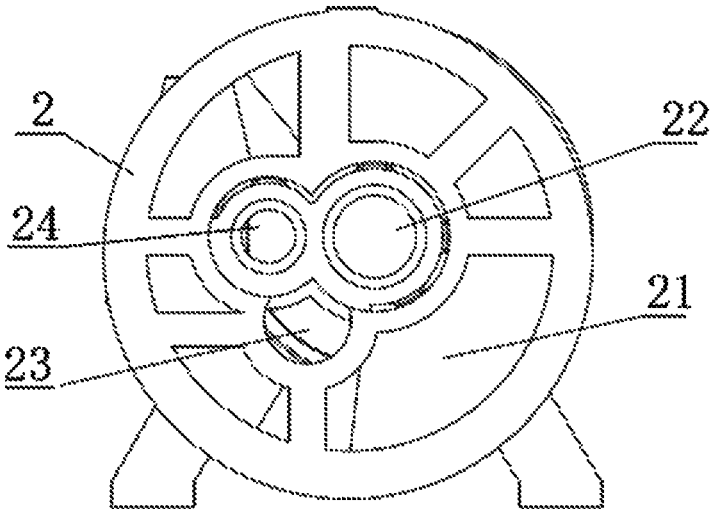
FIG. 5 is a schematic view showing the structure of an end surface of the exhaust end of the machine body of the compressor exhaust structure according to the present application.

As shown in FIG. 5, the machine body 2 is provided with a second exhaust chamber 21, a male rotor chamber 22, a slide valve chamber 23, and a female rotor chamber 24. The second exhaust chamber 21 is arranged in an exhaust-side end surface of the machine body 2 and is located at a position opposite to the bearing discharge chamber 11. The second exhaust chamber 21 is separated from a suction end, the rotor chamber and the slide valve chamber 23, and may be separated by a partition. The bearing discharge chamber 11 is engaged with the second exhaust chamber 21 face to face, the bearing discharge chamber 11 is overlapped with a portion of the second exhaust chamber 21, and a portion of the second exhaust chamber 21, which portion is not overlapped with the bearing discharge chamber 11, forms the gas flow passage 3.

The gas flow enters the bearing discharge chamber 11 via the bearing exhaust port 12, and enters the second exhaust chamber 21 from the overlapping portion of the bearing discharge chamber 11 and the second exhaust chamber 21, and then flows into the third exhaust chamber 31 through the gas flow passage 3, which is narrow and long, formed by the portion not overlapped with the bearing discharge chamber 11, of the second exhaust chamber 21, and finally is discharged out via the discharge port 51 of the oil separating barrel 5.

In an exemplary embodiment of the compressor exhaust structure according to the present application, the bearing discharge chamber 11 is located below the male rotor bearing chamber 13, and the second exhaust chamber 21 is located below the male rotor chamber 22. This is because of the fact that side portions of the female rotor bearing chamber 14 and the slide valve chamber 15 are generally used to arrange oil supply passages of the slide valve chamber 15, and also the exhaust bearing seat 1 is closer to the side of the female rotor than to the side of the male rotor in an overall arrangement of the exhaust bearing seat 1 and the machine body 2, which is determined by the fact that the male rotor drives the female rotor, and thus the side of the slide valve chamber 15 and the male rotor bearing chamber 13 has a relatively large axial space than, which facilitates the arrangement of the bearing discharge chamber 11.

As shown in FIGS. 1, 2 and 3, a working process of a specific embodiment of the compressor exhaust structure according to the present application is as follows: the exhaust gas in the rotor chamber enters the bearing discharge chamber 11 in the exhaust bearing seat 1 via the bearing exhaust port 12 located in the exhaust bearing seat 1, and is discharged through the bearing discharge chamber 11 and enters the second exhaust chamber 21. After that, the gas flow flows into the third exhaust chamber 31 through the gas flow passage 3 formed between the exhaust bearing seat 1 and the machine body 2.

The exhaust bearing seat 1 and the machine body 2 according to the present application cooperate with each other to form the gas flow passage 3, so that the exhaust gas flows into the machine body 2 firstly through the exhaust bearing seat 1 and then is discharged to the oil separating barrel 5 through the machine body 2, thereby facilitating the insulation of gas flow noise and reducing gas flow pulsation.

The compressor exhaust structure according to the present application can be applied in a screw compressor.

The screw compressor according to the present application includes the compressor exhaust structure according to the present application. The compressor exhaust structure includes the exhaust bearing seat 1, the machine body 2 and the oil separating barrel 5 (as shown in FIGS. 1 and 6).

In the screw compressor according to the present application, a flow passage for gas flow is formed by the exhaust bearing seat 1, the machine body 2 and the oil separating barrel 5. The gas flow flows into the exhaust bearing seat 1 firstly, enters the bearing discharge chamber 11 via the bearing exhaust port 12 in the exhaust bearing seat 1, enters the second exhaust chamber 21 in the machine body 2 through the bearing discharge chamber 11, and then flows into the third exhaust chamber 31 from the second exhaust chamber 21, that is, enters the oil separating barrel 5, and then is discharged out of the screw compressor via the discharge port 51 of the oil separating barrel 5.

In the screw compressor according to the present application, the portion of the second exhaust chamber 21 which portion is not overlapped with the bearing discharge chamber 11, in the lower side of the machine body 2 is configured as the gas flow passage 3, which can further help insulate the noise.

In the screw compressor according to the present application, the gas flow discharged from the exhaust bearing seat 1 enters the machine body 2 firstly, and then enters the oil separating barrel 5 from the machine body 2, and finally flows out, which extends the flow path of the gas flow, facilitates the insulation of gas flow noise, and reduces gas flow pulsation.

The screw compressor according to the present application can be applied to an air-conditioning unit.

In an exemplary embodiment of the air-conditioning unit according to the present application, the air-conditioning unit includes the screw compressor according to any one of the above embodiments.

Finally, it should be noted that, the above embodiments are only intended for describing the technical solutions of the present application and should not be interpreted as limitation to the technical solutions of the present application. Although the present application is described in detail in conjunction with the above preferred embodiments, it should be understood by the person skilled in the art that, modifications may still be made to the embodiments of the present application or equivalent substitutions may still be made to part of the technical features of the present application without departing from the spirit of the technical solutions of the present application, and all those modifications and equivalent substitutions should be encompassed within the scope of the technical solution claimed by the present application.

What is claimed is:

1. A compressor exhaust structure, comprising:

a machine body, an exhaust bearing seat provided at an exhaust end of the machine body, and an oil separating barrel covering the exhaust bearing seat, wherein:

the exhaust bearing seat is provided with a first exhaust chamber, the machine body is provided with a second exhaust chamber, a third exhaust chamber is formed between the exhaust bearing seat and an inner wall of the oil separating barrel, the first exhaust chamber is in fluid communication with the second exhaust chamber, the second exhaust chamber is in fluid communication with the third exhaust chamber, and the third exhaust chamber is in fluid communication with a discharge port of the oil separating barrel; and wherein an interior of the first exhaust chamber is located opposite to an interior of the second exhaust chamber, and the first exhaust chamber is overlapped with a portion of the second exhaust chamber, and a portion of the second exhaust chamber, which portion is not overlapped with the first exhaust chamber, forms a gas flow passage which is in communication with the third exhaust chamber.

2. The compressor exhaust structure according to claim 1, wherein the first exhaust chamber comprises a bearing exhaust port and a bearing discharge chamber, the bearing exhaust port is arranged in an axial direction of the exhaust bearing seat, the bearing discharge chamber is arranged in an intake-side end surface of the exhaust bearing seat, and the bearing exhaust port is in communication with the bearing discharge chamber.

3. The compressor exhaust structure according to claim 2, wherein the bearing exhaust port is arranged below a male rotor bearing chamber and a female rotor bearing chamber in the exhaust bearing seat, and is located at an exhaust end of a slide valve chamber in the exhaust bearing seat.

4. A screw compressor, comprising the compressor exhaust structure according to claim 3.

5. The compressor exhaust structure according to claim 2, wherein the bearing discharge chamber is located below the male rotor bearing chamber in the exhaust bearing seat, and the second exhaust chamber is located below the male rotor chamber in the machine body.

6. A screw compressor, comprising the compressor exhaust structure according to claim 5.

7. The compressor exhaust structure according to claim 2, wherein a baffle is provided on the exhaust bearing seat at a position where the bearing discharge chamber is arranged, and the gas flow from the bearing discharge chamber is entered into the second exhaust chamber by the baffle.

8. A screw compressor, comprising the compressor exhaust structure according to claim 7.

9. A screw compressor, comprising the compressor exhaust structure according to claim 2.

10. A screw compressor, comprising the compressor exhaust structure according to claim 1.

11. An air-conditioning unit, comprising the screw compressor according to claim 10.

* * * * *